US007621434B2

(12) United States Patent
Sugihara

(10) Patent No.: US 7,621,434 B2
(45) Date of Patent: Nov. 24, 2009

(54) CLINCHER DEVICE OF STAPLER

(75) Inventor: Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 53 days.

(21) Appl. No.: 11/597,253

(22) PCT Filed: May 23, 2006

(86) PCT No.: PCT/JP2005/009370

§ 371 (c)(1),
(2), (4) Date: Nov. 20, 2006

(87) PCT Pub. No.: WO2005/115698

PCT Pub. Date: Dec. 8, 2005

(65) Prior Publication Data

US 2008/0029569 A1 Feb. 7, 2008

(30) Foreign Application Priority Data

May 27, 2004 (JP) ..... 2004-158297

(51) Int. Cl.
*B25C 5/02* (2006.01)

(52) U.S. Cl. ..... 227/155; 227/154; 227/119; 227/134

(58) Field of Classification Search ..... 227/154–155, 227/119, 134
See application file for complete search history.

(56) References Cited

U.S. PATENT DOCUMENTS 2,185,518 A * 1/1940 Posnack ..... 29/432.1
4,378,085 A * 3/1983 McVeigh ..... 227/79
4,844,319 A * 7/1989 Kurosawa ..... 227/79
5,009,355 A * 4/1991 Akizawa et al. ..... 227/114
6,036,074 A * 3/2000 Manabe ..... 227/155
6,250,531 B1 * 6/2001 Yagi ..... 227/79
7,111,378 B2 * 9/2006 Aldana ..... 29/525.05
7,124,926 B1 * 10/2006 Tsai ..... 227/155
7,159,749 B2 * 1/2007 Tsai ..... 227/155
7,228,999 B2 * 6/2007 Oide et al. ..... 227/155
2005/0269380 A1 * 12/2005 Shimizu et al. ..... 227/155
2007/0210136 A1 * 9/2007 Sugihara et al. ..... 227/155

FOREIGN PATENT DOCUMENTS

JP 3-29274 U 3/1991
JP 4-23269 U 2/1992
JP 6-83281 U 11/1994
JP 10-128682 5/1998
WO WO 03/057417 A1 7/2003

* cited by examiner

*Primary Examiner*—Louis K. Huynh
*Assistant Examiner*—Michelle Lopez
(74) *Attorney, Agent, or Firm*—Morgan, Lewis & Bockius LLP

(57) ABSTRACT

A clincher device is provided with a thin plate piece disposed between a guide surface of a clincher member for bending and guiding legs of a staple and a rear surface of sheets of paper. The legs of the staple penetrating through the sheets of paper are guided and bent along a lower surface of the thin plate piece. The clincher device is further provided with an operation piece protruded upward from the clincher device. The operation piece is operated via the sheets of paper by a staple driving portion which is operated to approach toward and separate from the clincher device. The operation piece moves the thin plate piece relative to the staple after a completion of a binding operation of the sheets of paper so that the thin plate piece sandwiched by the legs of the staple is pulled out from the legs of the staple.

5 Claims, 10 Drawing Sheets

CLINCHER DEVICE OF STAPLER

TECHNICAL FIELD

The present invention relates to a clincher device of a stapler which strikes out a staple toward sheets of paper to be bound by a staple driving portion and bends legs of the staple penetrated through the sheets of paper along a rear surface of the sheets of paper.

BACKGROUND ART

In a stapler which is arranged to bend legs of a staple penetrated through sheets of paper to be bound along a rear surface of the sheets of paper thereby to bind the sheets of paper, a staple driving portion for striking out the staple toward the sheets of paper is disposed on one side of a feeding path of the sheets of paper, and a clincher device for bending the legs of the staple penetrating through the sheets of paper and protruding to the rear surface side of the sheets of paper along the rear surface of the sheets of paper is disposed on the other side of the feeding path so as to oppose to the staple driving portion across the feeding path. In the general clincher device for the stapler having been known conventionally, a fixed clincher, provided at an upper end surface with guide grooves for bending and guiding a pair of the legs of the staple toward the inside, is disposed on a rear surface side of the sheets of paper. The pair of the legs of the staple struck out toward the sheets of paper from a front surface side of the sheets of paper by the driving portion are protruded to a rear surface side of the sheets of paper and engage with the guide grooves, whereby the legs are bent and guided toward the inside.

In the aforesaid fixed clincher, a staple is struck toward the sheets of paper by a driver plate provided at the staple driving portion. The legs of the staple, which penetrate the sheets of paper and protrude to the rear surface side of the sheets of paper, engage with the guide grooves and are bent and guided toward the inside. The staple is formed at a base portion of each of the legs thereof with curved loops so that the tip ends of the legs of the staple abut against the rear surface of the sheets of paper thereby to complete the staple binding. According to the staple binding using such the fixed clincher, since the height of the loop formed at the base portion of each of the legs of a staple is quite large as compared with a thickness of the sheet of paper, the thickness of the bound portion by the staple becomes large. Thus, when plural sets of bound papers are stacked, the plural sets of bound papers incline.

JP-A-10-128682 discloses an electric stapler including a clincher device provided with movable clinchers which respectively operate to engage with the legs of the staple, which penetrate the sheets of paper and protrude to the lower surface side of the sheets of paper, and to bend the legs of the staple from the base portion sides thereof. According to such the clincher device, a pair of the movable clinchers are disposed on the lower surface side of the sheets of paper, and after almost the entire portions of the legs of the staple penetrate the sheets of paper, the movable clinchers are operated thereby to bend the legs of the staple from the base portions thereof along the rear surface of the sheets of paper. When such the movable clinchers are employed, the loops formed at the both ends of a staple can be eliminated or the height of the loops can be made small. Thus, since the bound shape of the staple can be made flat, such a phenomenon can be prevented from occurring that when plural sets of bound papers are stacked, the plural sets of bound papers incline.

However, in this clincher device using the movable clinchers according to the related art, a driving mechanism for operating the movable clinchers is needed. In the electric stapler arranged so as to strike the staple by the electric motor, the movable clinchers are operated at a suitable timing after the staple penetrates the sheets of paper by a driver driven by the electric motor. Thus, a related driving mechanism such as a cum and a link for driving the movable clinchers by the electric motor for driving the driver is required, which results in an increase of a cost of the electric stapler. Further, in the electric stapler in which the staple driving portion and the clincher device are separately disposed at the both sides of the feeding path so as to oppose to each other across the feeding path, it is necessary to provide a driving source such as another electric motor for driving the clincher device, which results in the further increase of the cost.

DISCLOSURE OF THE INVENTION

One or more embodiments according to the invention provide a clincher device for a stapler which can make the bound shape of a staple flat without requiring a driving force on the clincher device side and can feed sheets of paper smoothly.

According to one or more embodiments of the invention, the clincher device for a stapler is arranged in a manner that in a stapler which bind sheets of paper by using a staple driving portion for striking out a staple formed in a U-shape toward the sheets of paper and a clincher device for bending legs of the staple penetrating through the sheets of paper along a rear surface of the sheets of paper, the clincher device is constituted by a clincher member which is provided at an upper end surface thereof with a guide surface for bending and guiding the legs of the staple toward the inside and a thin plate piece made of metal which is disposed between the guide surface of the clincher member and the rear surface of the sheets of paper. The legs of the staple penetrated through the sheets of paper are guided and bent along the lower surface of the thin plate piece. Further, the clincher device is provided with an operation piece protruded from the upper end surface of the clincher device. The operation piece is operated via the sheets of paper by the staple driving portion which is operated to approach toward and separate from the clincher device. Thus, the operation piece moves the thin plate piece relative to the staple after a completion of the binding operation of the sheets of paper and so the thin plate piece sandwiched by the legs of the staple is pulled out from the legs of the staple.

Further, according to one or more embodiments of the invention, the thin plate piece is disposed so as to be slidable in a forward and backward direction with respect to the clincher device, the thin plate piece is urged by a spring in a direction that a tip end of the thin plate piece is evacuated from a position above the guide surface, and the thin plate piece is configured so as to be interlocks with the operation piece. The operation piece is operated via the sheets of paper by the staple driving portion which is operated to approach the clincher device. Thus, the thin plate piece is operated to the position covering the portion above the guide surface of the clincher member against the biasing force of the spring. When the staple driving portion is operated to separate from the clincher device, the thin plate piece is operated by the biasing force of the spring to an evacuated position on a backward side from the portion above the guide surface of the clincher member, and so the thin plate piece is pulled out from a space between the legs of the staple.

Further, according to one or more embodiments of the invention, the clincher device is configured by the clincher member having, at the upper end surface thereof, the guide surface for bending and guiding the legs of a staple toward the inside and a thin plate piece made of metal disposed between the guide surface of the clincher member and the rear surface of the sheets of paper. The legs of a staple penetrated through the sheets of paper are guided and bent along the lower surface of the sheets of paper. Thus, without using a movable clincher mechanism requiring an electric power on the clincher device side, the legs of a staple can be bent along the rear surface of the sheets of paper in a clinch shape in a flat manner in which the height of a loop shape formed at the base portion of each of the legs of the staple is small. As a result, the structure of the stapler, in particular, the portion of the clincher device can be simplified and the cost thereof can be reduced.

Furthermore, according to one or more embodiments of the invention, the staple after the binding operation of the sheets of paper is moved relative to the thin plate piece thereby to pull out the thin plate piece sandwiched by the legs of the staple from the legs of the staple. Thus, there does not arise such a phenomenon that binding papers can not be fed since the thin plate piece is sandwiched by a staple. As a result, in particular, even in a case of the stapler housed with in a copying machine etc. which uses no electric power for feeding sheets of paper, the sheets of paper after the binding operation of the staple can be fed smoothly.

Furthermore, according to one or more embodiments of the invention, the clincher device is provided with the operation piece protruded upward from the upper end surface of the clincher device. The operation piece is operated via the sheets of paper by the staple driving portion which is operated to approach toward and separate from the clincher device, whereby the operation piece moves the thin plate piece relative to the staple. Thus, in particular, the invention can be applied to a stapler employing a fixed clincher mechanism in which it is not necessary to provide a power source such as an electric motor for operating the thin plate piece on the clincher device side, and the staple driving portion and the clincher device are disposed so as to oppose to each other across the feeding path of sheets of paper, and the clincher device has no power source.

Furthermore, according to one or more embodiments of the invention, the thin plate piece is disposed so as to be slidable in a forward and backward direction with respect to the clincher device. The thin plate piece is urged by the spring in the direction that the tip end of the thin plate piece is evacuated from the position above the guide surface, and the thin plate piece is configured so as to interlock with the operation piece. The operation piece is operated via the sheets of paper by the staple driving portion which is operated to approach toward the clincher device. Thus, the thin plate piece is operated to the position covering a portion above the guide surface of the clincher member against the biasing force of the spring. When the staple driving portion is operated to separate from the clincher device, the thin plate piece is operated by the biasing force of the spring to an evacuated position on the backward side from the portion above the guide surface of the clincher member, and so the thin plate piece is pulled out from a space between the legs of the staple.

Thus, there does not arise such a phenomenon that the sheets of paper can not be fed since the thin plate piece is sandwiched by a staple. As a result, in particular, even in a case of the stapler housed within a copying machine etc. Which uses no electric power for feeding the sheets of paper, the sheets of paper after the binding operation of the staple can be fed smoothly. Thus, the invention can be applied to a stapler employing a fixed clincher mechanism in which it is not necessary to provide a power source such as an electric motor for operating the thin plate piece on the clincher device side and the clincher device has no power source.

Other features and effects will be apparent from the description of embodiments and appended claims.

BRIEF DESCRIPTION OF THE DRAWINGS

FIG. 8(*b*) is a diagram showing a state where the tip ends of the legs of a staple are guided along the rear surface of a thin plate piece.

FIG. 8(*c*) is a diagram showing a state where the binding operation of a staple is completed.

EXPLANATION OF REFERENCE NUMERALS

Figure 1:
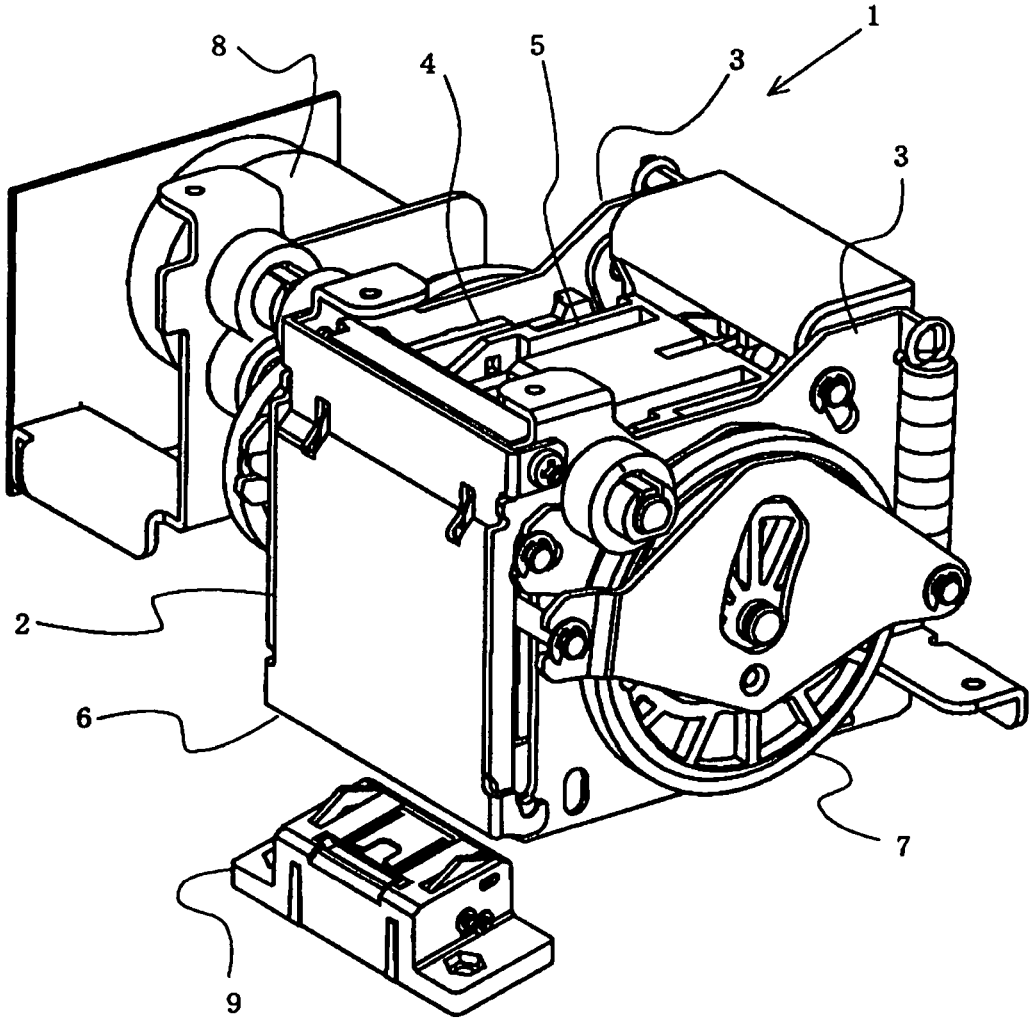
FIG. 1 is a perspective view showing an electric stapler according to one or more embodiments of the invention.

1 electric stapler
2 staple driving portion
9 clincher device
10 clincher member
11 induction guide surface
12 thin plate piece
13 clincher holder
18 operation piece
20 rotation link
24 compression spring

BEST MODE FOR CARRYING OUT THE INVENTION

Hereinafter, one or more embodiments of the invention will be explained with reference to the drawings.

Embodiment 1

FIG. 1 is a perspective view showing an electric stapler on which a clincher mechanism according to the one or more embodiments of the invention is mounted. The electric stapler 1 is disposed along a feeding path of sheets of paper formed within a copying machine or a printer etc. and binds a plurality of sheets of paper having been copied or printed. A staple driving portion 2 is disposed on one side of the feeding path and strikes out a staple toward the sheets of paper. The staple driving portion is constituted by a magazine 4 supported between a pair of supporting frames 3 and a cartridge 5 which houses many staples therein and is attached within the magazine 4. The staple driving portion is arranged in a manner that a staple driving mechanism formed within the magazine 4 strikes out a staple supplied to a striking portion 6 formed at the forward portion of the cartridge 5 toward binding papers disposed beneath the striking portion 6. A driving rotation member 7 is supported on the outer side surface of the supporting frame 3. A driving motor 8 disposed in adjacent to the supporting frame 3 rotates the driving rotation member 7 to drive the staple driving mechanism.

Figure 2:
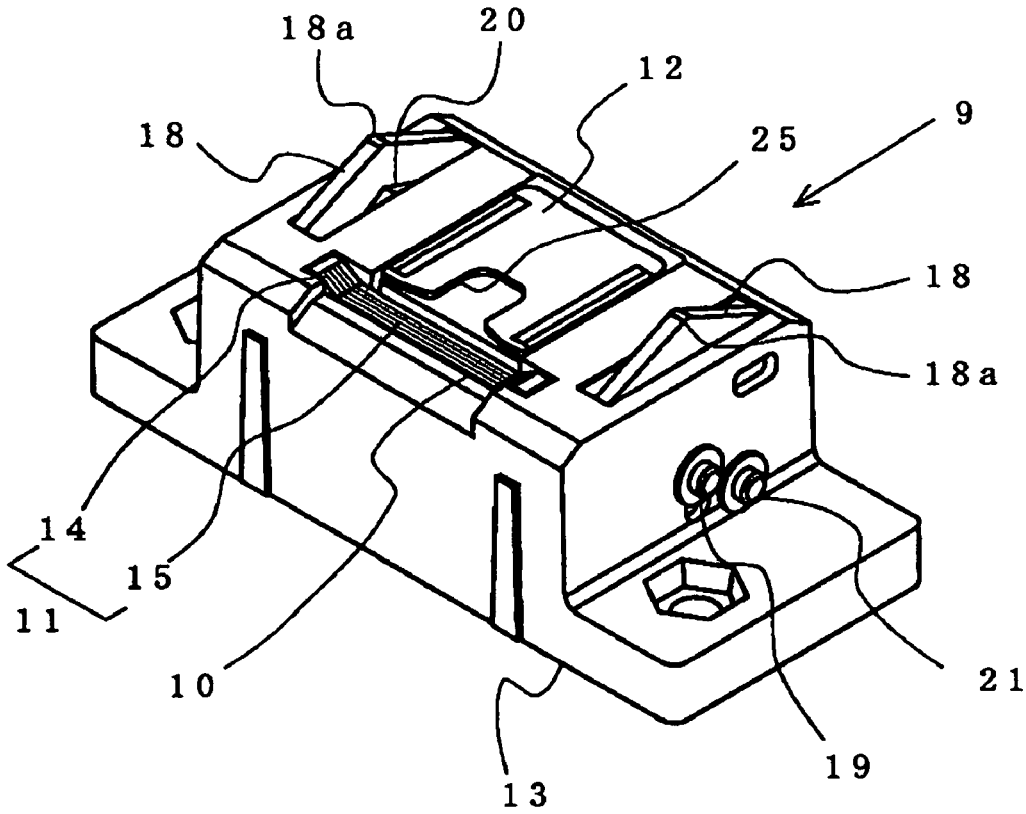
FIG. 2 is a perspective view of the clincher device of the electric stapler shown in FIG. 1.
Figure 3:
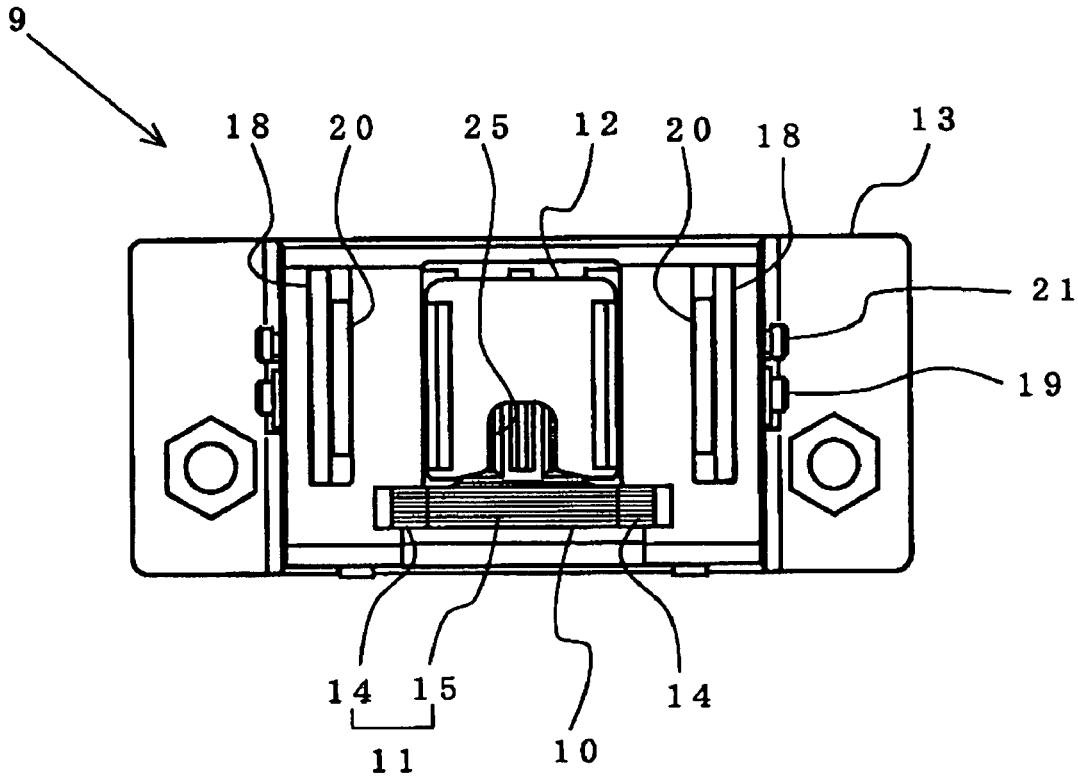
FIG. 3 is a plan view of the clincher device same as that shown in FIG. 2.
Figure 4:
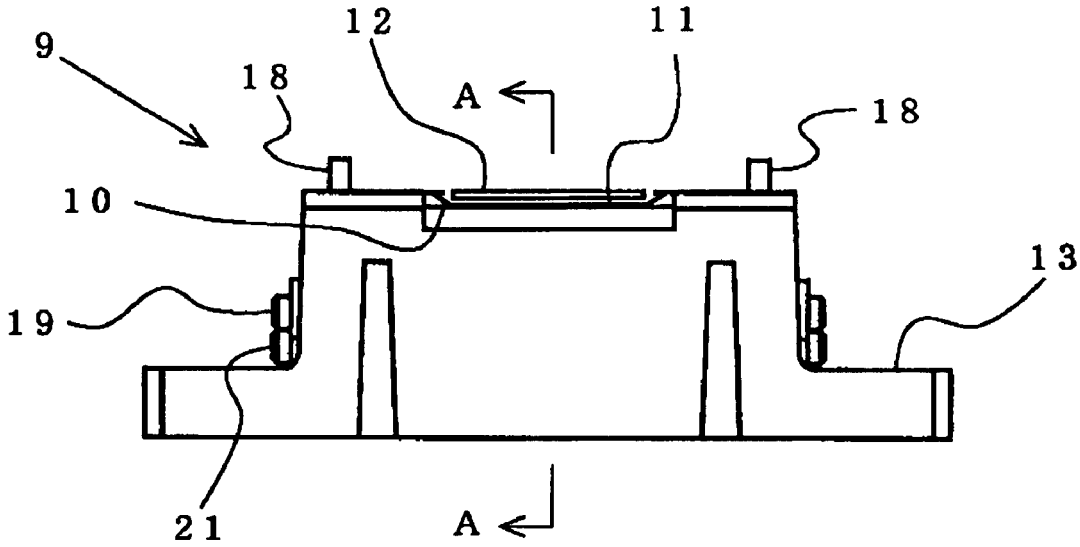
FIG. 4 is a front view of the clincher device same as that shown in FIG. 2.

A clincher device 9 is disposed on the opposite side of the feeding path of papers 5 so as to oppose to the striking portion 6 of the staple driving portion 2. The clincher device 9 operates to bend the legs of a staple, which is struck out from the staple driving portion 2 toward the sheets of paper and penetrates through the sheets of paper, along a rear surface of the sheets of paper. As shown in FIGS. 2 to 4, the clincher device 9 is constituted by a clincher member 10, provided on an upper surface thereof with an induction guide surface 11 which engages with the pair of legs of the staple penetrated through the sheets of paper and guides both the legs toward the inside, a thin plate piece 12 disposed between the clincher member 10 and the binding paper so as to cover the upper space of the induction guide surface of the clincher member 10, and a clincher holder 13 which holds the clincher member 10 and the thin plate piece 12.

The clincher member 10 is formed by metal. On the upper end surface of the clincher member 10, there is provided with the induction guide surface 11 which engages with the pair of legs of the staple penetrated through the sheets of paper and protruded on the rear surface side of the sheets of paper and guides both the legs toward the inside thereby to bend both the legs along the rear surface of the sheets of paper. The induction guide surface 11 is formed by inclined surfaces 14, arranged so as to engage with the pair of legs of the staple penetrated through the sheets of paper and protruded on the lower surface side of the sheets of paper and guide both the legs toward the inside, and a guide surface 15 arranged so as to extend horizontally in order to guide the legs of the staple directed toward the inside along the rear surface of the undermost binding paper. The clincher member 10 is held by the clincher holder 13 so that the induction guide surface 11 opposes to the striking portion 6 of the staple driving portion 2.

Figure 5:
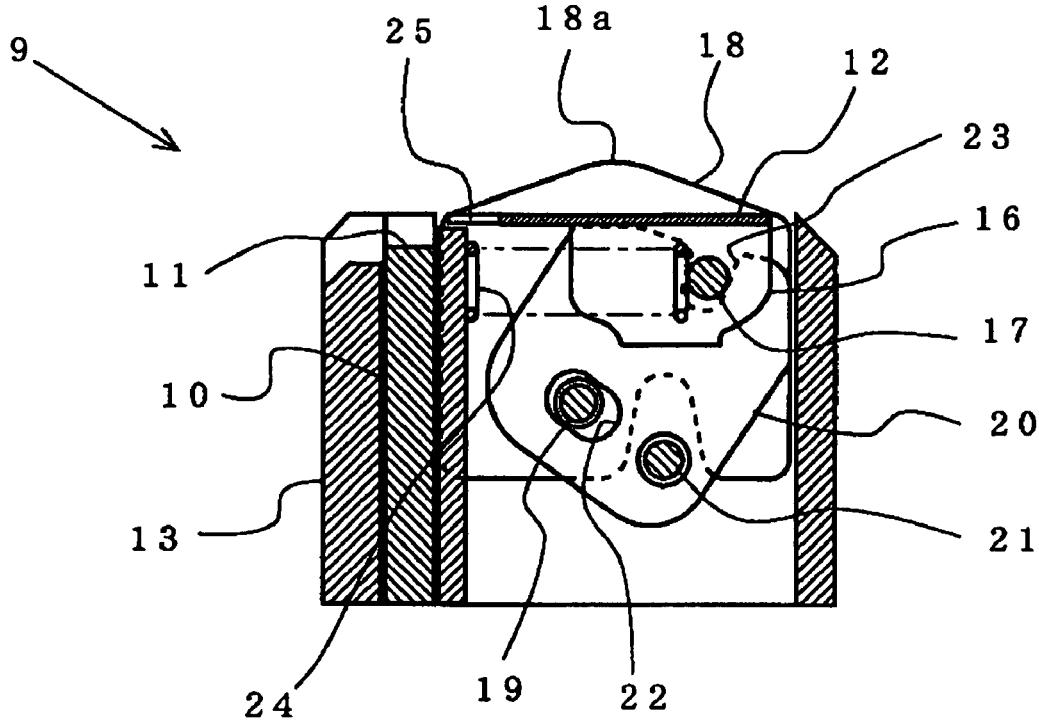
FIG. 5 is a sectional view along a line A-A in FIG. 4.
Figure 6:
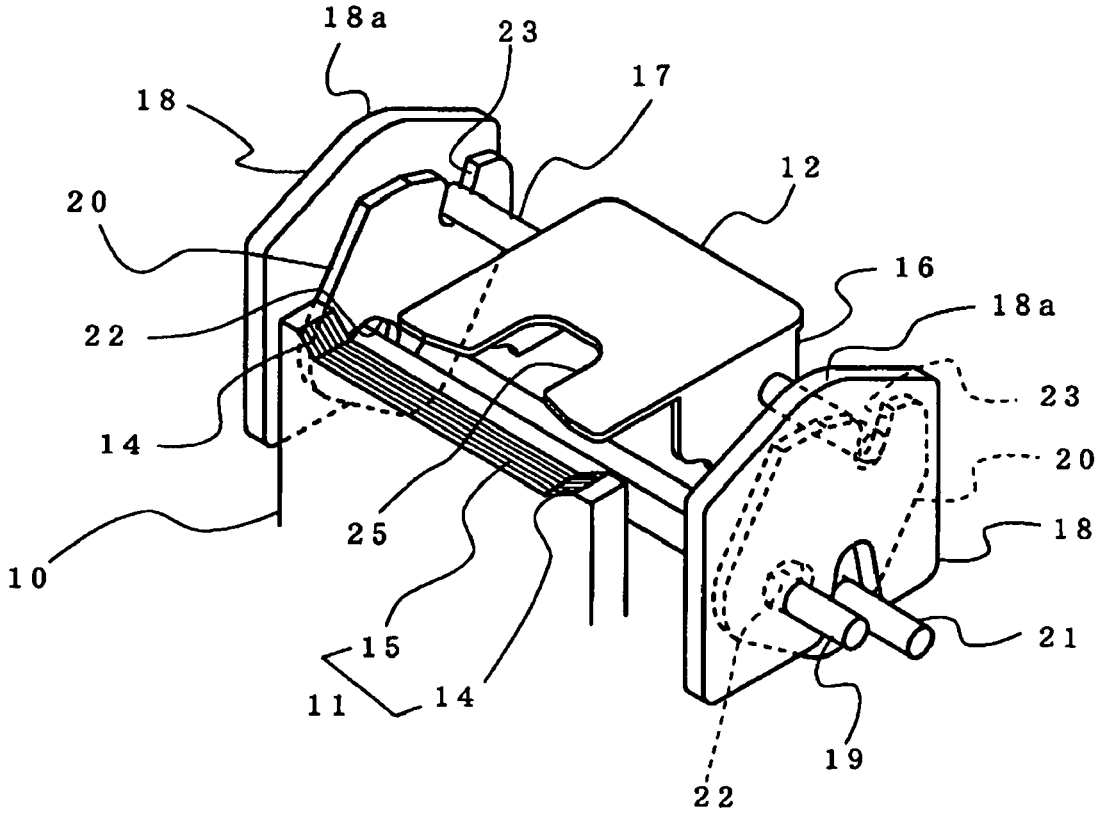
FIG. 6 is a perspective view showing the configuration of main parts of the clincher device.

On the upper end surface of the clincher holder 13, the thin plate piece 12 formed by a thin plate made of metal is disposed so as to be slidable in a forward and backward direction along the upper end surface of the clincher holder 13. As shown in FIGS. 5 and 6, the thin plate piece 12 is provided at both sides thereof with side pieces 16 which are integrally formed so as to be directed downward from the both side edges of the thin plate piece 12. Further, an operation lever 17 is integrally provided so as to penetrate the side pieces 16. The thin plate piece 12 is operated to move slidably in the forward and backward direction via the operation lever 17. In the normal state, as shown in FIG. 5, the thin plate piece 12 is disposed at an evacuated position where the tip end portion thereof is positioned on a backward side from the clincher member 10.

Further, a pair of operation pieces 18 slidable in the vertical direction are held and provided within the clincher holder 13 so as to be slidable along the both sides of the clincher holder 13. The upper ends 18*a* of the operation pieces 18 are disposed to protrude upward from the upper surface of the clincher holder 13. In order to strike a staple into binding papers placed on the clincher holder 13, the staple driving portion 2 is operated to approach the clincher holder 13, whereby the staple driving portion 2 engages with the upper ends 18*a* of the operation pieces 18 thereby to operatively press the upper ends 18*a* or the operation pieces 18 to a position where the upper ends thereof substantially coincide with the upper end surface of the clincher holder 13 and to operatively move the upper ends downward. An operation shaft 19 is penetrated through the pair of operation pieces 18 disposed at the both sides of the clincher holder 13. The operation shaft 19 is operated in the vertical direction in accordance with the sliding operation of the operation pieces 18 in the vertical direction.

A pair of operation links 20 are provided at the clincher holder 13 in adjacent to the pair of operation pieces 18 so as to be rotatable by means of a rotation supporting shaft 21. The operation shaft 19 penetrated through the operation pieces 18 is loosely fit into long holes 22 formed at the operation links 20. When the operation shaft 19 moves in the vertical direction in accordance with the movement of the operation pieces 18, the operation links 20 are operated to rotate around the rotation supporting shaft 21. Further, each of the operation links 20 is provided with a recess portion 23. The operation lever 17 penetrated through the side pieces of the thin plate piece 12 is loosely fit into the recess portions 23. When the operation links 20 are operated to rotate in accordance with the operation of the operation pieces 18, the operation lever 17 moves in the forward and backward directions thereby to move the thin plate piece 12 in the forward and backward directions.

Figure 7:
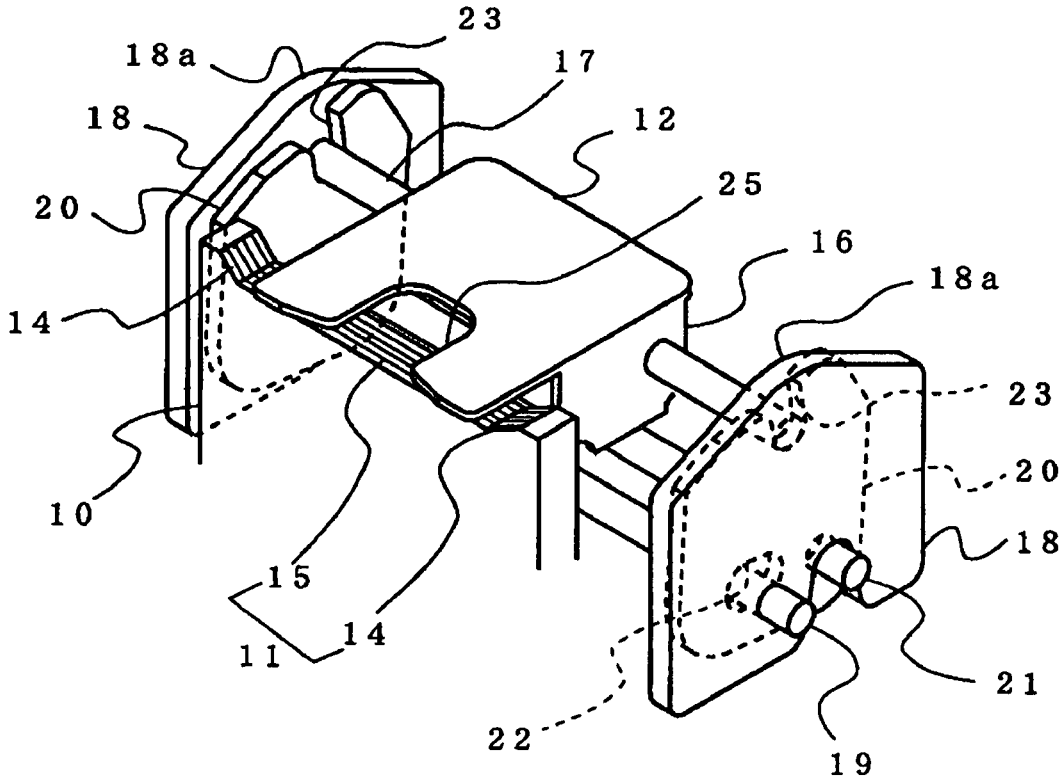
FIG. 7 is a perspective view same as that shown in FIG. 6 showing the operation state of the clincher device.

As shown in FIG. 5, the thin plate piece 12 is arranged in a manner that a compression spring 24 is disposed between the clincher holder 13 and the operation lever 17 so that the thin plate piece 12 is pressed toward the backward side, that is, the tip end portion of the thin plate piece 12 is pressed and biased to the evacuated position on the backward side from the clincher member 10. As shown in FIGS. 5 and 6, in the normal state, the thin plate piece 12 is operated by the biasing force of the compression spring 24 in a manner that the tip end portion of the thin plate piece 12 is moved to the evacuated position on the backward side from the clincher member 10. Binding papers are placed on the clincher holder 13, and then the staple driving portion 2 is operated to approach the clincher holder 13 in order to strike a staple into binding papers thereby to sandwich the binding papers between the staple driving portion 2 and the upper end surface of the clincher holder 13. Thus, as shown in FIG. 7, the upper ends 18*a* of the operation pieces 18 protruded upward from the upper end surface of the clincher holder 13 are operated downward via the binding papers by the staple driving portion 2. Then, the thin plate piece 12 is operated in the forward direction against the biasing force of the compression spring 24 via the operation links 20 rotated by the operation shaft 19 and the operation lever 17 operated via the operation links 20, whereby the thin plate piece 12 is disposed in a manner that the tip end thereof covers a portion above the guide surface 15 of the induction guide surface 11 of the clincher member 10. In this respect, a portion above each of the inclined surfaces 14 of the induction guide surface 11 of the clincher member 10 is not covered by the thin plate piece 12 so that the legs of a staple, which is struck out from the staple driving portion 2 and penetrated through binding papers, can be landed on the inclined surfaces 14, respectively.

The thin plate piece 12 is formed by the thin metal plate with a thickness of about 0.2 mm. In this embodiment, a notch portion 25 is formed at the center portion of the front edge of the thin plate piece 12. In the state where the binding operation of the staple is completed, the tip end potions of the legs of the staple protrude upward from the notch portion 25 and directly adhere closely to the rear surface of the undermost binding paper. Thus, for example, even when the number of sheets paper to be bound is small, the tip end potions of the legs of a staple can be bent so as to be adhered closely to the rear surface of the sheets of paper, so that the sheets of paper can be bound more firmly. Further, on the surfaces of the inclined surfaces 14 and the guide surface 15 forming the induction guide surface 11 of the clincher member 10, guide grooves which interval is set to be smaller than the diameter of a staple are formed in order to guide the legs of the staple along the width direction of the clincher member 10. Thus, the legs of a staple can be surely bent toward the inside without being deviated in the forward or backward direction.

Figure 8A:
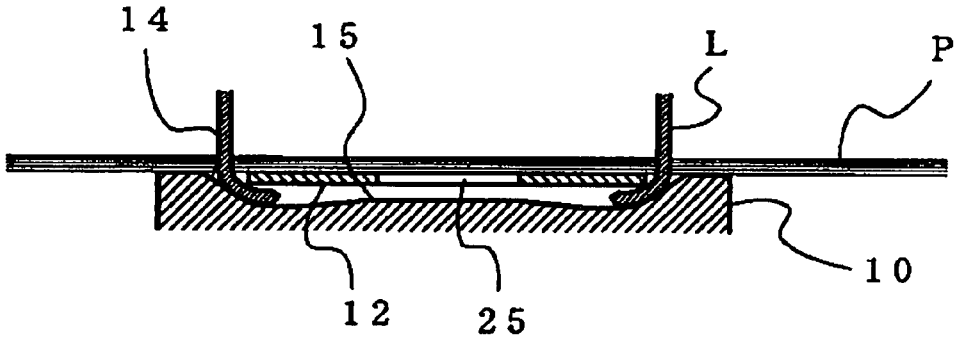
FIG. 8(*a*) is a diagram showing a state where the tip ends of the legs of a staple penetrated through binding papers are guided toward the inside by the slanted surfaces of an induction guide surface.
Figure 8B:
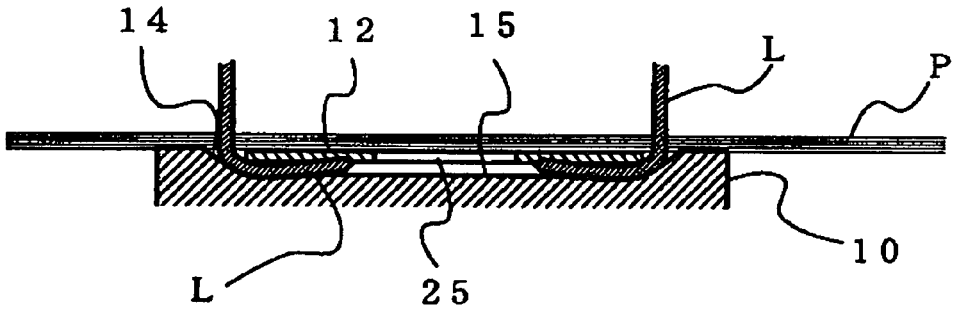
Figure 8C:
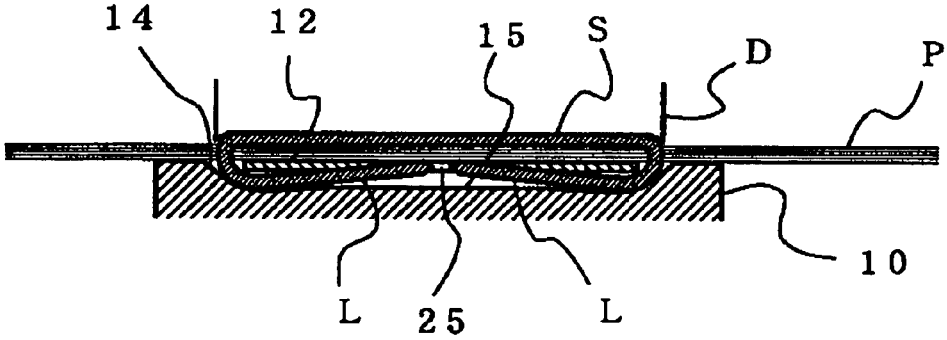

The explanation will be made with reference to FIG. 9 as to the clinch operation state of a staple by the thin plate piece 12 and the clincher member 10 of the clincher device 9. After the sheets of paper are disposed on the upper surface of the clincher device 9, when the staple driving portion 2 is moved toward the clincher device 9 so that the sheets of paper are sandwiched between the staple driving portion 2 and the clincher device 9, the operation pieces 18 are operated by the staple driving portion 2, whereby the thin plate piece 12 is operated in the forward direction and disposed between the portion above the induction guide surface 11 of the clincher member 10 and the rear surface of the sheets of paper. In this state, when a staple S is struck out toward the sheets of paper P by the driving plate D of the staple driving portion 2, the tip ends of the legs L of the staple S penetrate the binding papers P and engage with the inclined surfaces 14 of the induction guide surface 11 of the clincher member 10, whereby the legs L are guided and bent toward the inside by the inclined surfaces 14 as shown in FIG. 8(*a*).

Further, when the striking operation of the staple S by the plate D of the staple driving portion 2 proceeds, the legs are guided along the inclined surfaces 14 and the guide surface 15 of the induction guide surface 11, and the tip ends of the legs L are guided slightly upward. Then, as shown in FIG. 8(*b*), the tip ends of the legs L engage with the rear surface side of the thin plate piece 12 and reformed in a manner of being guided along the rear surface of the thin plate piece 12. When the staple S is struck out to the final position by the driving plate D, as shown in FIG. 8(*c*), the staple S protrudes upward from the notch portion 25 thereby to bind the sheets of paper P in a manner that the thin plate piece 12 is held by the legs L of the staple on the rear surface side of the sheets of paper.

Next, the operation of the thin plate piece 12 will be explained in the case where the thin plate piece 12 bound together with the sheets of paper P by the legs L of the staple is pulled out from the space between the legs L of the staple. As shown in FIG. 5, the staple driving portion 2 is separated from the upper surface of the portion 10 before the binding operation of a staple is performed. Thus, since the operation pieces 18 are not operated by the staple driving portion 2 yet, the thin plate piece 12 is disposed at the position that the front end portion thereof is moved backward from the upper surface of the surfaced 11 of the clincher member 10 by the biasing force of the compression spring 24. In accordance with this arrangement, the upper ends 18*a* of the operation pieces 18 protrude upward from the upper end surface of the clincher holder 13.

Figure 9:
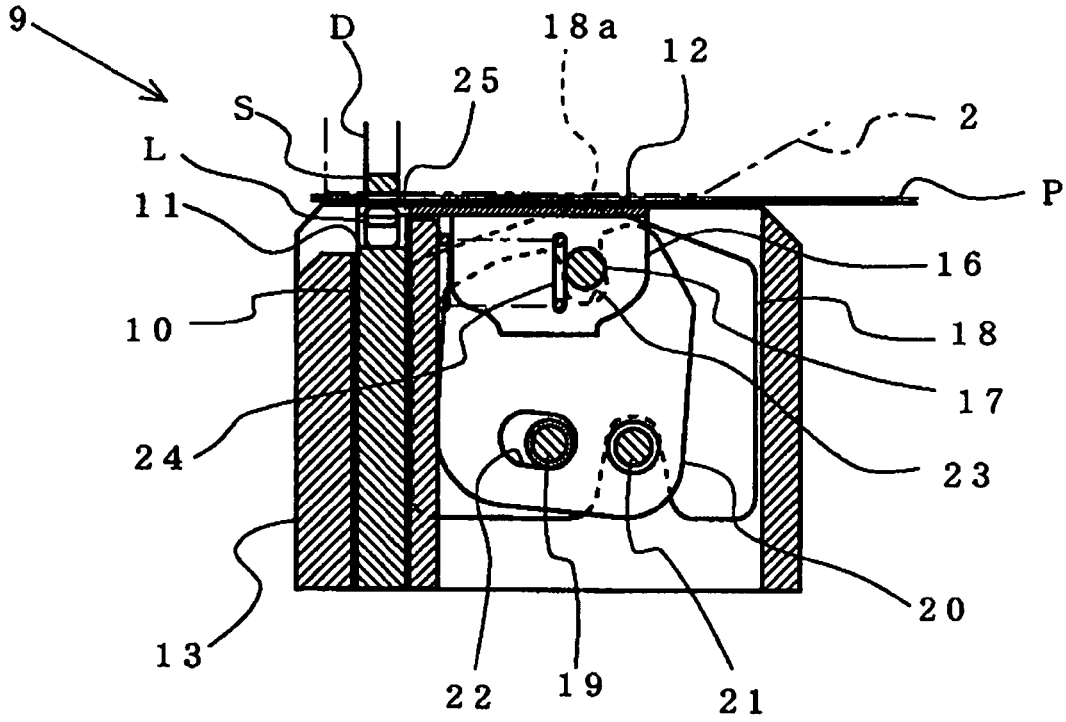
FIG. 9 is a sectional view same as that shown in FIG. 5 showing a state where the thin plate piece is operated in the forward direction to perform the binding operation of a staple.

When the sheets of paper P are disposed between the clincher device 9 and the staple driving portion 2, and the staple driving portion 2 is operated to sandwich the sheets of paper P between the staple driving portion and the clincher holder 13 in order to strike out a staple into the sheets of paper P, as shown in FIG. 9, the staple driving portion 2 is operated to press the upper ends 18*a* of the operation pieces 18 protruding from the upper end surface of the clincher holder 13 via the binding papers P thereby to move the operation pieces 18 downward. In accordance with this operation of the operation nieces 18, the thin plate piece 12 is operated to move in the forward direction via the operation shaft 19, the operation links 20 and the operation lever 17 against the spring biasing force of the compression spring 24, whereby the tip end portion of the thin plate piece 12 is disposed between the induction guide surface 11 of the clincher member 10 and the sheets of paper P. In this state, the staple binding operation for the binding papers P is performed as shown in FIGS. 8(*a*) to 8(*c*).

Figure 10:
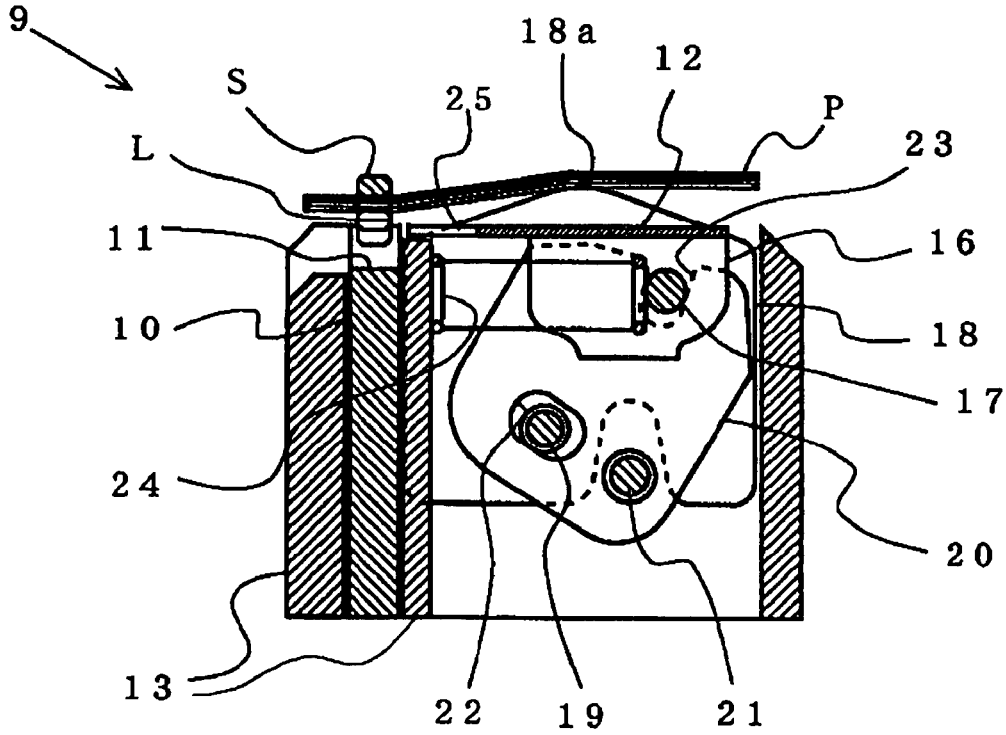
FIG. 10 is a sectional view same as that shown in FIG. 5 showing a state where, after the completion of the binding operation of a staple, the thin plate piece is operated to an evacuated position on the backward side and pulled out from the legs of the staple.
Figure 11:
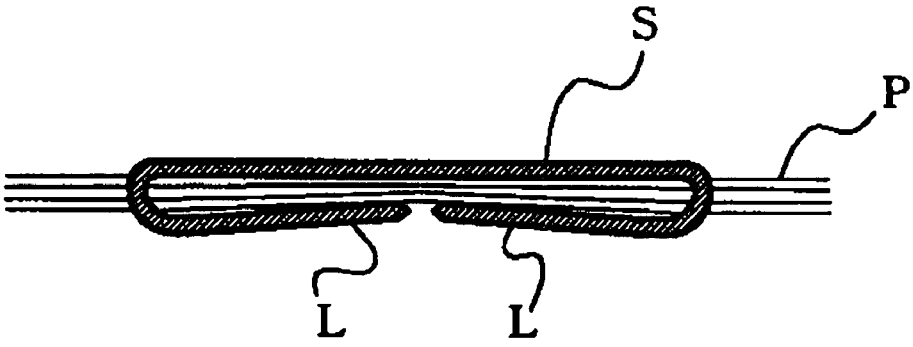
FIG. 11 is a sectional view showing binding papers and the staple in a state after the completion of the binding operation of the staple.

In a state of immediately after the completion of the staple binding operation, as shown in FIG. 9, the thin plate piece 12 is held by the legs L of the staple S which bind the sheets of paper. When the staple driving portion 2 is separated from the clincher device 9, an external force of pressing the operation pieces 18 is removed. Thus, as shown in FIG. 10, the thin plate piece 12 is moved backward by the spring biasing force of the compression spring 24 and disposed at the evacuated position where the tip end portion thereof is located on the backward side from the induction guide surface 11 of the clincher member 10. In this case, although both the thin plate piece 12 and the staple S holding the thin plate piece 12 are applied with a force for moving them together in the backward direction, the staple S engages with the edge of the clincher holder 13 housing the clincher member 10 and so prevented from moving backward. Thus, only the thin plate piece 12 moves backward and is pulled out from the space between the legs L of the staple S. Then, as shown in FIG. 11, each of the legs L of the staple S is bent along the rear surface of the sheets of paper P and deformed in an almost flat shape, thereby completing the staple binding operation. Since the thin plate piece 12 is formed by the thin metal plate with the thickness of about 0.2 mm, for example, even when the thin plate piece 12 having been bound between the legs L of the staple and the biding papers P is drawn out, the binding state of the binding papers P is not changed substantially.

In the aforesaid embodiments, the thin plate piece 12 is disposed so as to be slidable in the forward and backward direction, and the thin plate piece 12 is slidably operated in the backward direction and pulled out from the space between the legs L of the staple which are bent so as to bind the sheets of paper. Alternatively, the thin plate piece 12 may be disposed fixedly with respect to the clincher holder 13 so that the thin plate piece is disposed above the induction guide surface 11 of the clincher member 10, whereby a staple after binding the sheets of paper may be moved in the forward direction with respect to the clincher holder 13 thereby to pull out the staple in the tip end direction of the thin plate piece 12. As a mechanism for moving in the forward direction a staple having been clinched in this manner, the following mechanism is proposed. That is, the clincher holder 13 is provided with a pair of operation pins which are respectively capable of engaging with the both shoulder portions of a staple and are operated in the forward and backward directions. An operation piece partially protruded from the upper end surface of the clincher holder 13 so as to be operated by the staple driving portion 2 is interlocked with the operation pins via a lever link mechanism etc. The operation pins are evacuated in the backward direction when a staple is struck out by the staple driving portion 2. Then, when the staple driving portion 2 is separated from the clincher portion after the completion of the staple binding operation, the operation pin is operated in the forward direction and engaged with the both shoulder portions of the staple legs. Then, the staple is moved in the forward direction with respect to the clincher holder 13 and pulled out in the tip end direction of the thin plate piece 12.

As described above, according to the one or more embodiments of the invention, the thin plate piece 12 is disposed above the induction guide surface 11 of the clincher member 10, and the legs of a staple is guided along the rear surface of the thin plate piece 12, whereby the legs of a staple can be bent in a flat manner along the rear surface of the sheets of paper without using the movable clincher mechanism which requires an electric power on the clincher device 9 side. Further, the thin plate piece 12 is disposed so as to be slidable on the clincher device 9, and after the completion of the clinching operation of the staple by the operation of the staple driving portion 2, the thin plate piece is operated slidably so as to be evacuated from the induction guide surface 11 of the clincher member 10 thereby to pull out the thin plate piece 12 from the space between the legs of the staple and the sheets of paper. Thus, the sheets of paper after the completion of the staple binding operation can be fed smoothly even in the case of a stapler which is housed within a copying machine etc. using no power for feeding papers, in particular.

Furthermore, the thin plate piece 12 is operated via the operation pieces 18 protruded from the upper end surface of the clincher holder 13 by the staple driving portion 2 disposed so as to oppose to the clincher device 9. Thus, in particular, the invention can be applied to a stapler employing a fixed clincher mechanism in which it is not necessary to provide a power source such as an electric motor for operating the thin plate piece 12 on the clincher device 9 side, and the staple driving portion 2 and the clincher device 9 are disposed so as to oppose to each other across the feeding path of papers, and the clincher device 9 has no power source.

Although the invention has been explained in detail with reference to particular embodiments, it will be apparent for those skilled in the art that various variations and modifications can be made without departing from the spirit and scope of the invention.

The present application is based on Japanese Patent Application (Patent Application No. 2004-158297) filed on May 27, 2004, the entire contents of which are incorporated herein by reference.

INDUSTRIAL APPLICABILITY

The clincher device of a stapler according to the invention can be applied not only to an electric stapler which is housed within a copying machine or a printing machine etc. and arranged to strike out a staple toward sheets of paper by an electric motor like the aforesaid embodiments but also to an electric stapler used independently on a desk without being housed within the copying machine or the printing machine etc. and also to a manually driven type stapler having no power driving source such as an electric motor.

The invention claimed is:

1. A clincher device of a stapler for bending legs of a staple struck out by a staple driving portion along a rear surface of a sheet of paper to be bound, the clincher device comprising:

a clincher member including, at an upper end surface thereof, a guide surface for bending and guiding the legs of the staple toward inside;

a thin plate piece disposed between the guide surface and the rear surface of the sheet of paper; the thin plate piece being slidable with respect to the clincher member in a forward direction above the clincher guide surface and in a backward direction wherein a tip end of the thin plate piece is evacuated from a position above said guide surface;

an operation piece protruding upward from the upper end surface of the clincher device and configured to be operated by the staple driving portion to move downwardly and upwardly with respect to said upper end surface of the clincher device; and an operating lever interconnecting the thin plate piece and the operation piece, wherein, upon the downward movement of the operation piece, the thin plate piece slides forwardly above the clincher guide surface to guide and bend the legs of the staple along a lower surface of said thin plate piece, and wherein upon upward movement of the operation piece, the thin plate piece slides backwardly.

2. The clincher device of a stapler according to claim 1, wherein the legs of the staple penetrated through the sheet of paper are bent along a lower surface of the thin plate piece.

3. The clincher device of a stapler according to claim 2, wherein the operation piece is operated by the staple driving portion moving toward the clincher device, the thin plate piece is operated to a position covering a portion above the guide surface of the clincher member against a biasing force of a spring, and when the staple driving portion is operated to separate from the clincher device, the thin plate piece is operated by the biasing force of the spring to an evacuated position translated away from the portion above the guide surface of the clincher member, and the thin plate piece is pulled out from a space between the legs of the staple.

4. The clincher device for a stapler according to claim 1, wherein the thin plate piece is urged, by a spring, in the direction that the tip end of the thin plate piece is evacuated from the position above the guide surface.

5. The clincher device for a stapler according to claim 1, wherein the operation piece is operated by the staple driving portion moving toward the clincher device, the thin plate piece is operated to a position covering the portion above the guide surface of the clincher member against a biasing force of the spring, and when the staple driving portion is operated to separate from the clincher device, the thin plate piece is operated by the biasing force of the spring to an evacuated position translated away from the portion above the guide surface of the clincher member, and the thin plate piece is pulled out from a space between the legs of the staple.

* * * * *

UNITED STATES PATENT AND TRADEMARK OFFICE

CERTIFICATE OF CORRECTION

PATENT NO. : 7,621,434 B2
APPLICATION NO. : 11/597253
DATED : November 24, 2009
INVENTOR(S) : Shinpei Sugihara It is certified that error appears in the above-identified patent and that said Letters Patent is hereby corrected as shown below:

Title Page

Item (22), should read:

--PCT Filed: May 23, 2005--

Signed and Sealed this

Twentieth Day of April, 2010

David J. Kappos

David J. Kappos
*Director of the United States Patent and Trademark Office*